US007596822B2

(12) United States Patent
Sakaldasis et al.

(10) Patent No.: US 7,596,822 B2
(45) Date of Patent: Oct. 6, 2009

(54) APPARATUS AND METHODS FOR LIFTING BED MATTRESSES AND/OR TUCKING IN BED COVERS

(75) Inventors: Elizabeth Sakaldasis, Sonoma, CA (US); Carisa Harris-Adamson, Sonoma, CA (US); Susan Schafer, San Francisco, CA (US); Bradley Duvernay, San Francisco, CA (US); Esther Soria Sonson, San Francisco, CA (US); Gaye Frisby, San Francisco, CA (US); Thomas Blundell, San Francisco, CA (US)

(73) Assignees: Hyatt Corporation, Chicago, IL (US); PreCare, Inc., Sonoma, CA (US)

( * ) Notice: Subject to any disclaimer, the term of this patent is extended or adjusted under 35 U.S.C. 154(b) by 8 days.

(21) Appl. No.: 11/464,719

(22) Filed: Aug. 15, 2006

(65) Prior Publication Data

US 2008/0040859 A1 Feb. 21, 2008

(51) Int. Cl.
*A47C 31/00* (2006.01)

(52) U.S. Cl. ..... 5/658; 5/482

(58) Field of Classification Search ..... 5/658, 5/482; 29/239, 253; 254/104
See application file for complete search history.

(56) References Cited

U.S. PATENT DOCUMENTS

| | | | | |
|---|---|---|---|---|
| 2,087,148 | A | 7/1937 | Hempy | |
| 2,291,015 | A | 7/1942 | Anderson | |
| 2,504,176 | A * | 4/1950 | Brehmer | 254/104 |
| 2,774,178 | A | 10/1956 | Nelson | |
| 3,551,016 | A | 12/1970 | Hooper | |
| D246,345 | S | 11/1977 | Poncia | |
| 4,372,596 | A * | 2/1983 | Sanders | 294/9 |
| D268,073 | S | 3/1983 | Schaeffer | |
| D268,804 | S | 5/1983 | Bacon | |
| 4,433,463 | A * | 2/1984 | DuVal | 29/239 |
| D275,540 | S | 9/1984 | Barkow | |
| 4,520,518 | A | 6/1985 | Reaser | |
| 4,686,726 | A | 8/1987 | Dunfee | |
| 4,688,761 | A * | 8/1987 | Wilcox | 254/104 |
| 4,745,650 | A | 5/1988 | Elliott | |
| D362,376 | S | 9/1995 | Oaks | |
| 5,459,897 | A * | 10/1995 | Wurdack | 7/166 |
| 5,471,700 | A | 12/1995 | Pereira | |
| D376,966 | S | 12/1996 | Bartlett | |
| 5,850,657 | A | 12/1998 | List | |
| 6,012,227 | A | 1/2000 | Lent | |
| 6,134,743 | A | 10/2000 | Schmidt | |

(Continued)

OTHER PUBLICATIONS

International Search Report dated Mar. 28, 2008, Application No. PCT/USO7/75916 with Written Opinion.

*Primary Examiner*—Peter M. Cuomo
*Assistant Examiner*—William Kelleher
(74) *Attorney, Agent, or Firm*—Wildman, Harrold, Allen & Dixon LLP

(57) ABSTRACT

The invention discloses differing embodiments of apparatus, and methods for their use, which are designed to aide in lifting bed mattresses and tucking in bed covers. In some embodiments, kits are disclosed which include wedge apparatus for lifting bed mattresses, and tuck apparatus for tucking in bed covers. In other embodiments, wedge apparatus for lifting portions of bed mattresses are disclosed. In still other embodiments, tuck apparatus for tucking in bed covers are provided. Additional embodiments disclose methods for using the kits, wedge apparatus, and tuck apparatus.

4 Claims, 6 Drawing Sheets

U.S. PATENT DOCUMENTS

| | | | | |
|---|---|---|---|---|
| 6,163,919 | A | 12/2000 | Mitchell | |
| 6,263,578 | B1 | 7/2001 | Frantz | |
| 6,302,375 | B1 | 10/2001 | Heil | |
| 6,641,113 | B1 | 11/2003 | Budinich | |
| D493,078 | S | 7/2004 | McGee | |
| 6,880,198 | B1 | 4/2005 | Hazard | |
| 2007/0271706 | A1 * | 11/2007 | Gonser | 5/658 |

* cited by examiner

APPARATUS AND METHODS FOR LIFTING BED MATTRESSES AND/OR TUCKING IN BED COVERS

BACKGROUND OF THE INVENTION

The process of making a bed, including lifting a bed mattress and/or tucking in bed covers between the bed mattress and box spring mattress, or other support structure, can be physically taxing. Most often, beds are made manually without the aide of bed-making apparatus. Many of the known bed-making apparatus and methods of use experience one or more problems. Some representative problems with these bed-making apparatus and methods may include: requiring strenuous bed-making activity potentially resulting in fatigue and injury, requiring excessive time to make the bed, leading to poor quality made-beds, and/or other types of problems.

Bed-making apparatus and methods for their use are needed which may solve one or more problems in one or more of the existing bed-making methods and apparatus.

SUMMARY OF THE INVENTION

In one aspect of the invention, a kit is provided for tucking at least a portion of one bed cover under a mattress of a bed. The kit includes a wedge apparatus which comprises a wedge member for lifting a portion of the mattress of the bed. The wedge member includes a bottom surface and a sloped surface which form an acute angle. A first handle member is connected to the wedge member. The kit further includes a tuck apparatus. The tuck apparatus comprises a tuck member for tucking the portion of the bed cover under the mattress of the bed. At least one tucking surface is at one end of the tuck member. A second handle member is connected to the tuck member. At least one of the first and second handle members is oriented in non-parallel relationship with respect to the bottom surface of the wedge member and the tuck member respectively.

In another aspect of the invention, a method is provided of tucking a portion of a bed cover under a mattress of a bed. In one step, a sloped surface of a wedge apparatus is slid under the mattress of the bed in order to lift at least a portion of the mattress. In another step, a tucking surface of a tuck apparatus is pressed against a surface of the bed cover. In yet another step, the tucking surface is slid under the mattress in order to tuck the portion of the bed cover under the mattress.

These and other features, aspects and advantages of the invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
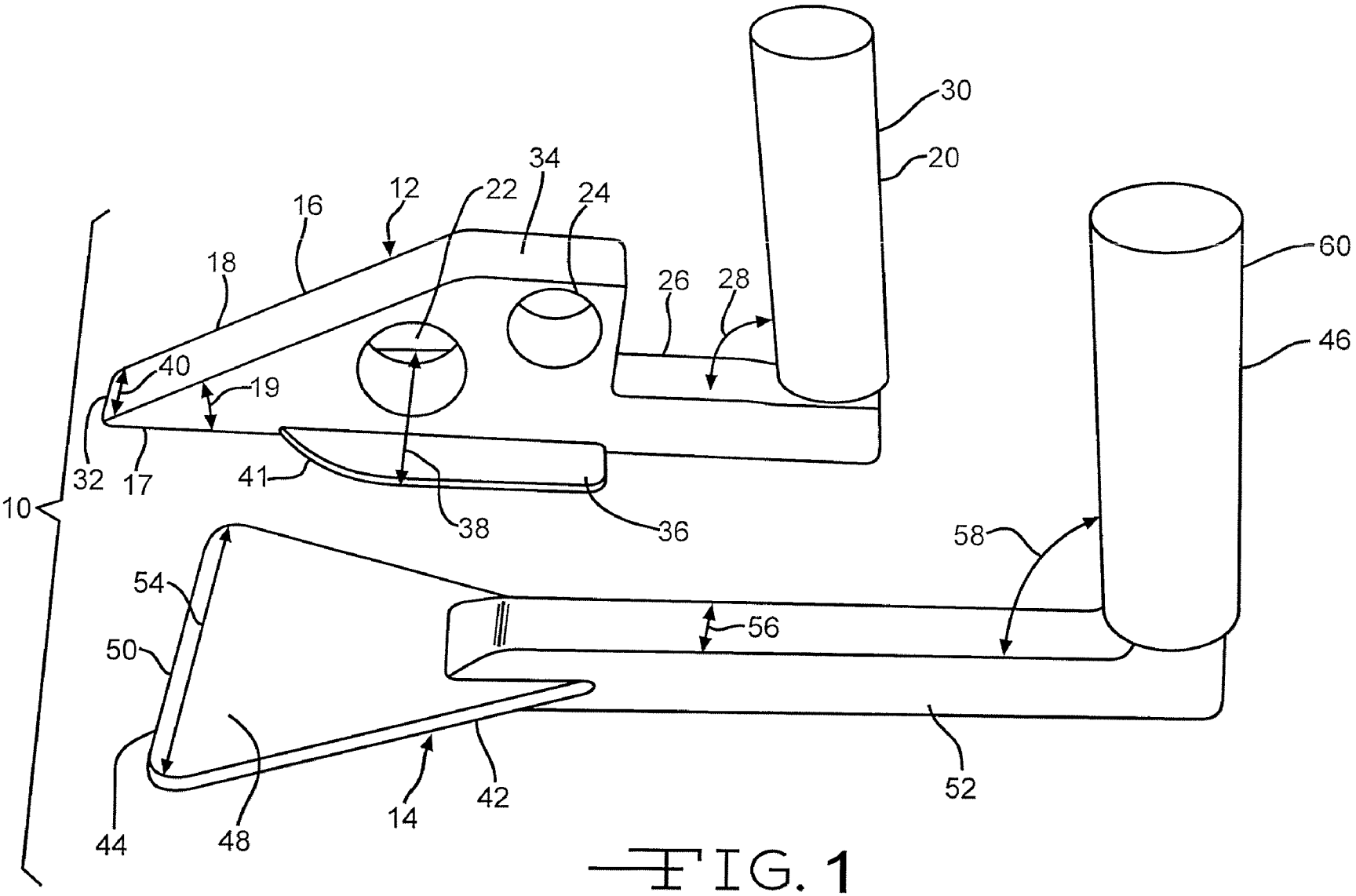
FIG. 1 is a perspective view of one embodiment of a bed-making kit under the invention.

In one embodiment of the invention, as shown in FIG. 1, a kit 10 is provided for tucking at least a portion of a bed cover under a bed mattress. For purposes of this application, the word "tucking" or "tuck" is defined as locating and/or positioning a portion of a bed cover under a bed mattress. The kit 10 may include a wedge apparatus 12 and a tuck apparatus 14. The wedge apparatus 12 may be adapted to aide in lifting a portion of a bed mattress in an upwardly direction off a box spring mattress in order to make it easier for a person making the bed to tuck in one or more bed covers between the bed mattress and box spring mattress. In other embodiments, the wedge apparatus 12 may be adapted to lift a portion of a bed mattress off other types of supporting structures. The tuck apparatus 14 may be adapted to tuck one or more portions of one or more bed covers under a bed mattress.

The wedge apparatus 12 of the kit 10 may comprise a wedge member 16 having a bottom surface 17, a sloped surface 18, and a first handle member 20 connected to the wedge member 16. The bottom surface 17 and the sloped surface 18 may be adjoining, and may form an acute angle 19 which facilitates the sloped surface 18 engaging a surface of a bed mattress, and facilitates lifting of the bed mattress. The wedge member 16 may be adapted for lifting a portion of a bed mattress. Two holes 22 and 24 may define the wedge member 16, and may extend horizontally through a cross-section of the wedge member 16. The holes 22 and 24 may be used to reduce the weight of the wedge apparatus 12, and may be circular or in other configurations, shapes, or quantities. A first connecting member 26 may connect the first handle member 20 to the wedge member 16. In other embodiments, the first handle member 20 may be connected to the wedge member 16 directly, or through other means. The first connecting member 26 may be substantially rectangular, round, oval, or in other configurations or shapes. For ergonomic reasons, the first handle member 20 may be in non-parallel relation with respect to the first connecting member 26, bottom surface 17, wedge member 16, and/or other portion of wedge apparatus 12. The first handle member 20 may be at an angle 28 with respect to the first connecting member 26 in substantially the range of 30 degrees to 120 degrees. In other embodiments, angle 28 may be substantially in the range of 60 to 90 degrees. A grip member 30 may cover one or more portions of the first handle member 20. The grip member 30 may be made of foam, rubber, or other materials.

Sloped surface 18 may be substantially linear, may begin at an end 32 of the wedge member 16, and may end at a mattress receiving surface 34. The mattress receiving surface 34 may be oriented in non-parallel relation with respect to sloped surface 18. The wedge member 16 may include a substantially planar stabilizing surface 36 having a width 38 wider than a width 40 of the sloped surface 18, and/or other portion of the wedge member 16. One or more portions 41 of the substantially planar stabilizing surface 36 may be curved. Both the mattress receiving surface 34 and the substantially planar stabilizing surface 36 may be adapted to be oriented in substantially horizontal planes when the sloped surface 16 is slid under a bed mattress and/or above a box spring mattress. The substantially planar stabilizing surface 36 may be oriented in parallel alignment with the mattress receiving surface 34. The first handle member 20 may be oriented in non-parallel alignment with both the substantially planar stabilizing surface 36 and the mattress receiving surface 34. In other embodiments, the wedge apparatus 12 and/or wedge member 16 may include one or more stop members (not shown) which may prevent the wedge member 16 from slipping out of a position in between a bed mattress and/or a box spring mattress.

When the wedge member 16 is upright, as shown in FIG. 1, so that it is oriented in a substantially vertical plane, the sloped surface 18 of the wedge member 16 may be adapted to be slid in between a bed mattress and a box spring mattress, locating one or more portions of the sloped surface 18 under the bed mattress and above the box spring mattress. In such manner, the bed mattress may be lifted upwardly off the box spring mattress due to the bed mattress being forced to slide up the sloped surface 18 of the wedge member 16. The described movement of the wedge member 16 may be achieved by a person grasping the first handle member 20 to apply a force to the wedge member 16 in order to slide the sloped surface 18 under a bottom surface of the bed mattress and above a top surface of the box spring mattress. The substantially planar stabilizing surface 36 may be slid on top of the box spring mattress forcing the bed mattress to be slid up the sloped surface 18 until the bed mattress comes to rest on top of the mattress receiving surface 34. In such manner, the bed mattress may be stabilized in a raised position on top of the mattress receiving surface 34 due to the use of the wedge apparatus 12.

The use of the wedge apparatus 12 may reduce the force required to lift the bed mattress off the box spring mattress. In some embodiments, the force required to lift the bed mattress off the box spring mattress may be reduced substantially in the range of 10 to 90 percent. In other embodiments, the force may be reduced by varying percentages.

The wedge apparatus 12 may be made of plastic or other types of materials. In other embodiments, the wedge apparatus 12 may be of varying shapes, sizes, configurations, and orientations, with differing numbers and types of sloped surfaces 18.

The tuck apparatus 14 of the kit 10 may comprise a tuck member 42 having a tucking surface 44, and a second handle member 46 connected to the tuck member 42 by a second connecting member 52. The tuck member 42 may be adapted for tucking a portion of a bed cover under a bed mattress. In other embodiments, the second handle member 46 may be directly connected to the tuck member 42, or connected by other means. The second handle member 46 may be in non-parallel relation with respect to tuck member 42, or other portion of tuck apparatus 14. The tuck member 42 may comprise a substantially planar, triangular surface 48. The tucking surface 44 of the tuck member 42 may lie at one end 50 of the tuck member 42, may be substantially linear, and may be substantially perpendicular to the second connecting member 52. A width 54 of the tucking surface 44 may be wider than a width 56 of the second connecting member 52 in order to allow contact with a greater portion of the bed cover being tucked in. The second connecting member 52 may be substantially rectangular, round, oval, or in other configurations or shapes. For ergonomic reasons, the second handle member 46 may be at an angle 58 with respect to the second connecting member 52 and/or tuck member 42 in substantially the range of 30 degrees to 120 degrees. In other embodiments, angle 58 may be substantially in the range of 60 to 90 degrees. A grip member 60 may cover one or more portions of the second handle member 46. The grip member 60 may be made of foam, rubber, or other materials.

When the sloped surface 18 of the wedge member 16 of the wedge apparatus 12 is located under a bed mattress and the tuck member 42 is oriented in a substantially horizontal plane, the tucking surface 44 of the tuck apparatus 14 is adapted to be pressed against one or more surfaces of one or more bed covers overhanging the bed mattress. While in this position, the tucking surface 44 may be adapted to be slid under a surface of the bed mattress and above a surface of the box spring mattress, in order to force a portion of the bed cover in between the box spring mattress and mattress, thereby tucking in that portion of the bed cover. Movement of the tucking surface 44 in such manner may be achieved by a person grasping the second handle member 46.

The use of the tuck apparatus 14 and/or wedge apparatus 12 may reduce the force required to tuck a portion of the bed cover under the bed mattress into a position in between the mattress and box spring mattress. In some embodiments, the force required to tuck the portion of the bed cover under the mattress may be reduced substantially in the range of 10 to 90 percent. In other embodiments, the force may be reduced by varying percentages.

The tuck apparatus 14 may be made of plastic or other types of materials. In other embodiments, the tuck apparatus 14 may be of varying shapes, sizes, configurations, and orientations, with differing numbers, types, and configurations of tucking members 42 and tucking surfaces 44.

Figure 2:
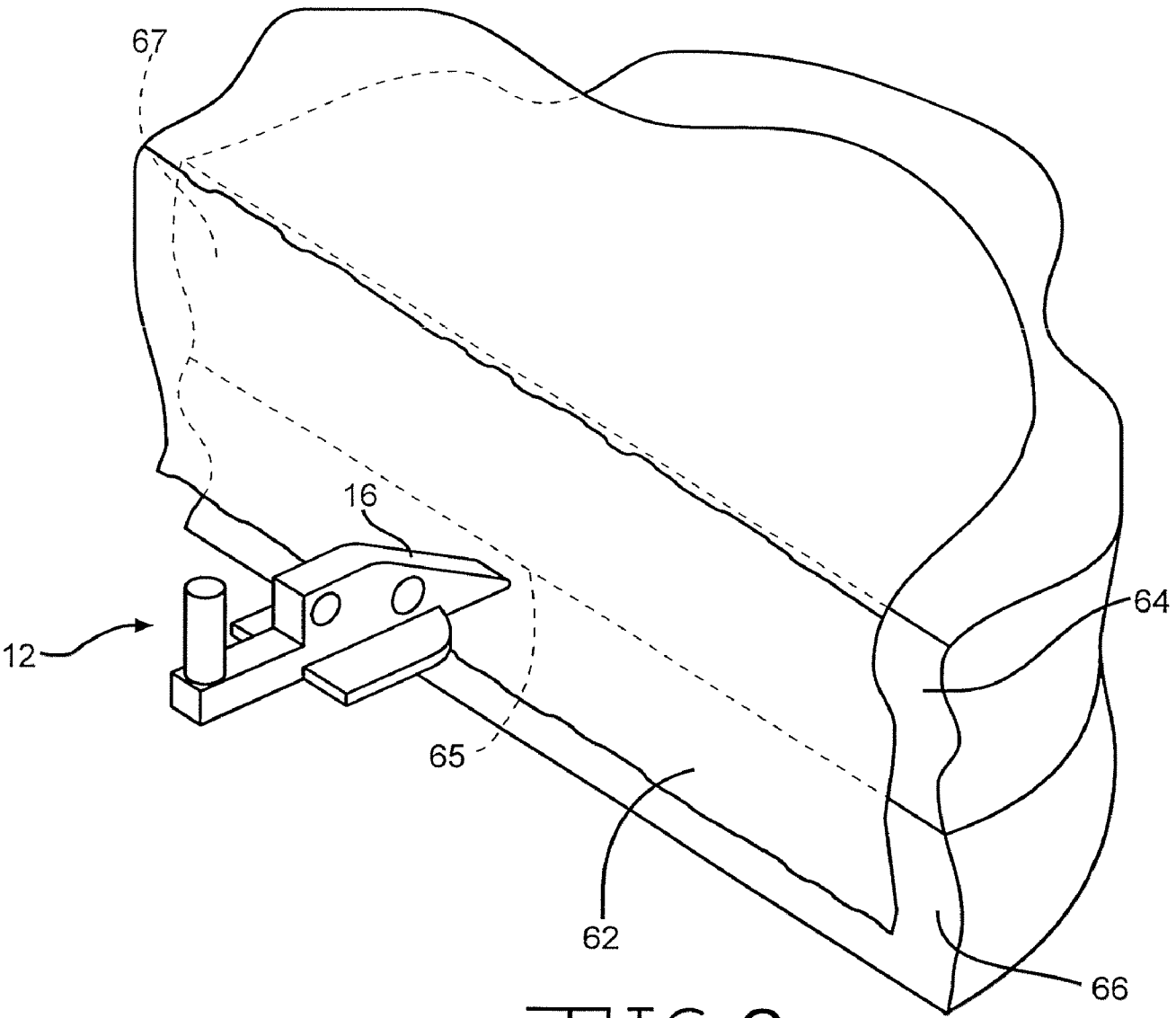
FIG. 2 is a partial, perspective view showing the step of positioning the wedge apparatus of FIG. 1 with respect to a bed mattress under one method embodiment for making a bed under the invention.

In another embodiment, a method is disclosed for tucking at least a portion of at least one bed cover under a mattress of a bed. The method may be used to tuck the bed cover in between a bed mattress and a box spring mattress, or other support structure. In one step of the method, as shown in FIG. 2, the wedge apparatus 12 of FIG. 1 may be positioned adjacent to one or more bed covers 62 overhanging a bed mattress 64 and a box spring mattress 66, or other support structure. In this position, a wedge member 16 of the wedge apparatus 12 may be aligned for engagement with a bottom surface of the bed mattress 64 and a top surface of the box spring mattress 66. In other embodiments, the wedge apparatus 12 may be positioned adjacent bed and box spring mattresses 64 and 66 without the presence of bed covers 62. The wedge apparatus 12 may be positioned adjacent a substantially center area 65 of a side portion 67 of the bed mattress 64. In other embodiments, the wedge apparatus 12 may be positioned at different areas of the bed mattress 64, such as the corners or other areas of the bed mattress 64. The wedge apparatus 12 may comprise any of the wedge apparatus embodiments disclosed within this specification.

Figure 3:
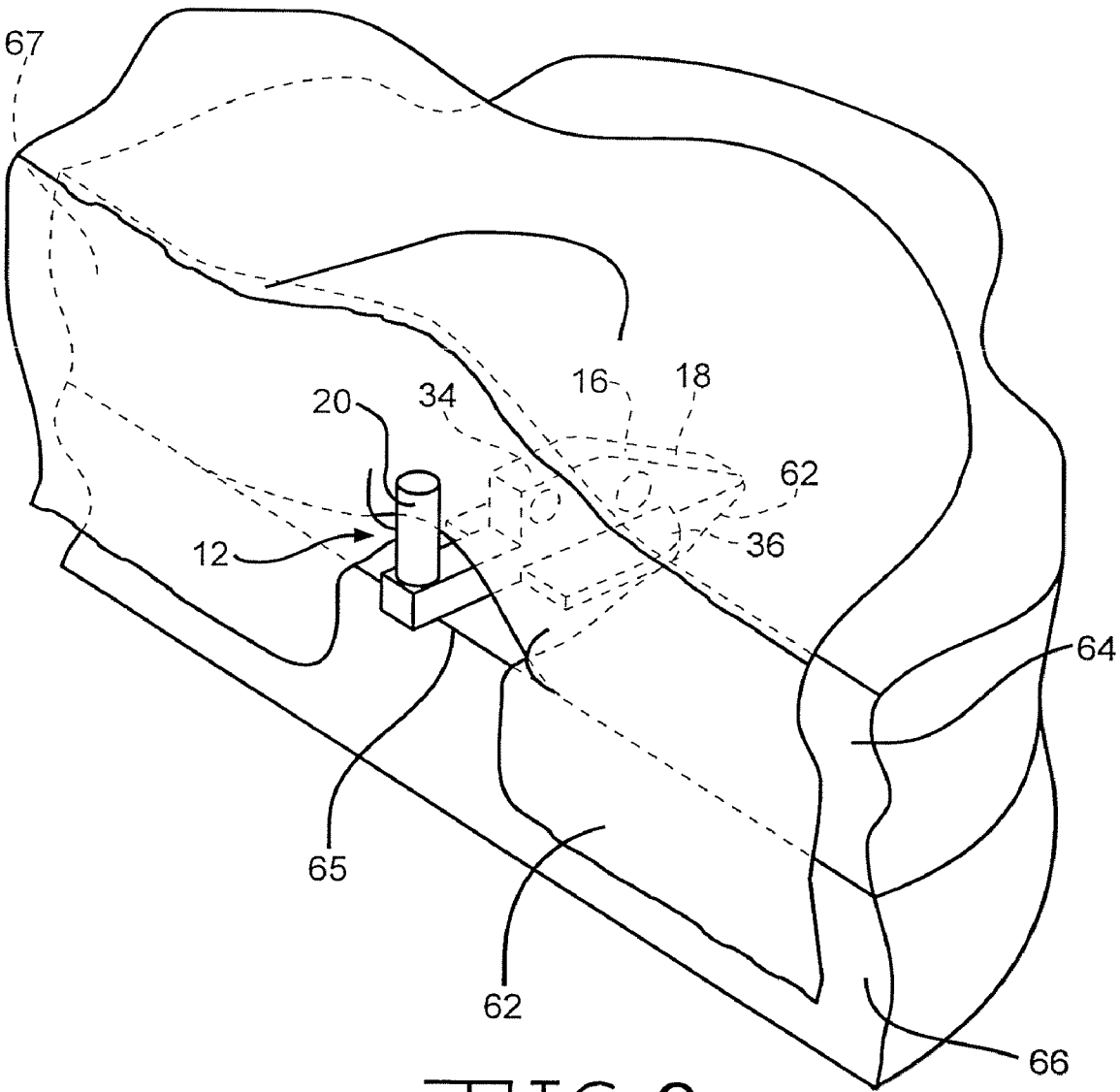
FIG. 3 is a partial, perspective view showing the step of sliding the wedge apparatus of FIG. 2 under the bed mattress under one method embodiment for making a bed under the invention.

In another step of the method, as shown in FIG. 3, a sloped surface 18 of the wedge apparatus 12 may be slid under the bed mattress 64, and above the box spring mattress 66 or other support structure, in order to lift at least a portion of the bed mattress 64 upwardly. The sloped surface 18 of the wedge apparatus 12 may be slid under the substantially center area 65 of the side portion 67 of the bed mattress 64. In other embodiments, the sloped surface 18 of the wedge apparatus 12 may be slid under different areas of the bed mattress 64 in order to lift different portions of the mattress 64 upwardly. For instance, the sloped surface 18 of the wedge apparatus 12 may be slid, at separate times, into substantially center areas of three different sides of the bed mattress 64 in order to aide in tucking in bed covers 62 on three sides of the bed mattress 64. In other embodiments, the sloped surface 18 of the wedge apparatus 12 may be slid into varying areas of any side of the bed mattress 64. The wedge apparatus 12 may be slid by a person grasping and applying a force to a first handle member 20 of the wedge apparatus 12 and sliding the sloped surface 18 under a bottom surface of the mattress 64 and above a top surface of the box spring mattress 66 or other support structure.

During this step, as shown in FIG. 3, the wedge member 16 of the wedge apparatus 12 may be oriented upright in a substantially vertical plane, and both a mattress receiving surface 34 and a substantially planar stabilizing surface 36 of the wedge apparatus 12 may be oriented in substantially horizontal planes. As the sloped surface 18 of the wedge apparatus 12 is slid under the bed mattress 64, the insertion of the sloped surface 18 may force a portion of one or more bed covers 62 overhanging the bed mattress 64 to be tucked between the bed mattress 64 and box spring mattress 66 in the area where the sloped surface 18 is inserted. After the sloped surface 18 of the wedge apparatus 12 is slid under the bed mattress 64, the bed mattress 64 may abut against the mattress receiving surface 34 of the wedge apparatus 12, which may be oriented in a substantially horizontal plane 36 to stabilize the mattress 64 in its position against the wedge apparatus 12. Similarly, after the sloped surface 18 of the wedge apparatus 12 is slid under the bed mattress 64, the box spring mattress 66 may be abutted against the substantially planar stabilizing surface 36 of the wedge apparatus 12, which may be oriented in a substantially horizontal plane to stabilize the wedge apparatus 12 in its position against the box spring mattress 66.

Figure 4:
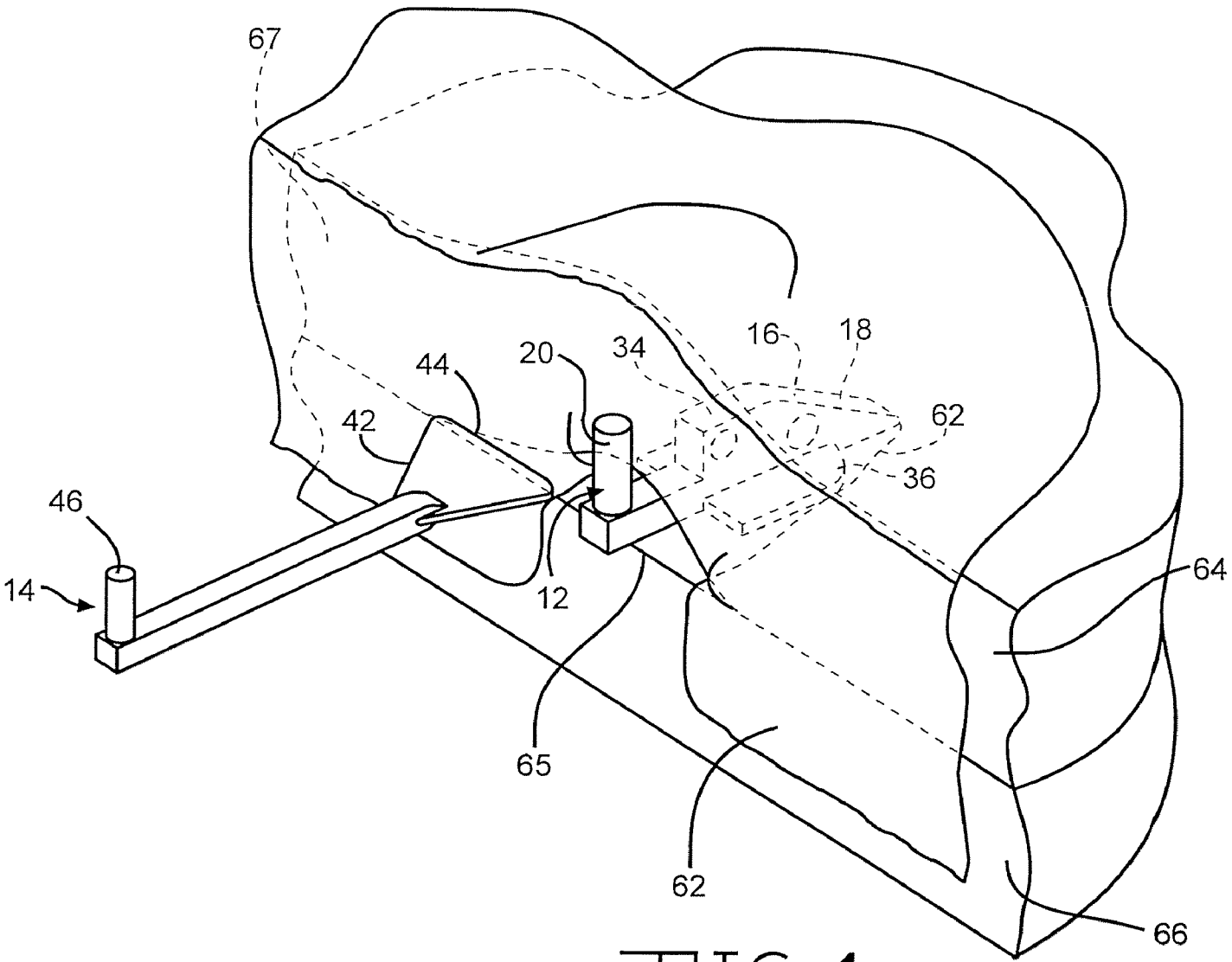
FIG. 4 is a partial, perspective view showing the step of positioning a tuck apparatus with respect to the bed mattress of FIG. 3 under one method embodiment for making a bed under the invention.

In yet another step of the method, as shown in FIG. 4, after the wedge apparatus 12 is slid under the bed mattress 64, a tuck member 42 of a tuck apparatus 14 may be oriented in a substantially horizontal plane, and a tucking surface 44 of the tuck apparatus 14 may be positioned adjacent and pressed against a surface of one or more of the bed covers 62 overhanging the bed mattress 64 and box spring mattress 66, or other support structure. The tucking surface 44 of the tuck apparatus 14 may be positioned adjacent and pressed against a substantially center area 65 of the side portion 67 of the bed mattress 64, just to the side of the location of the inserted wedge apparatus 12. In other embodiments, the tucking surface 44 of the tuck apparatus 14 may be positioned in a variety of positions with respect to the bed mattress 64, bed cover 62, and/or wedge apparatus 12. In still other embodiments, the tucking surface 44 of the tuck apparatus 14 may be positioned adjacent and pressed against different surfaces of the bed covers 62 along different areas of the bed mattress 64 in order to place the tucking surface 44 in position to tuck different portions of the bed covers 62 under different areas of the mattress 64. For instance, the tucking surface 44 of the tuck apparatus 14 may be positioned adjacent and pressed against, at separate times, substantially center areas on three different sides of the bed mattress.

Movement of the tucking surface 44 of the tuck apparatus 14 may be accomplished by a person grasping a second handle member 46 of the tuck apparatus 14. When the tucking surface 44 of the tuck apparatus 14 is positioned adjacent and pressed against a surface of one or more of the bed covers 62, the tuck member 42 may be oriented in a substantially horizontal plane. In other embodiments, the tuck member 42 may be oriented in various configurations or orientations. For instance, the tuck member 42 may be oriented in a substantially vertical plane and/or horizontal plane and the tucking surface 44 may be positioned adjacent and pressed against a portion of bed cover 62 lying in between a bed headboard (not shown) and the bed mattress 64. It should be noted that the tuck apparatus 14 may comprise any of the tuck apparatus embodiments disclosed within this specification.

Figure 5:
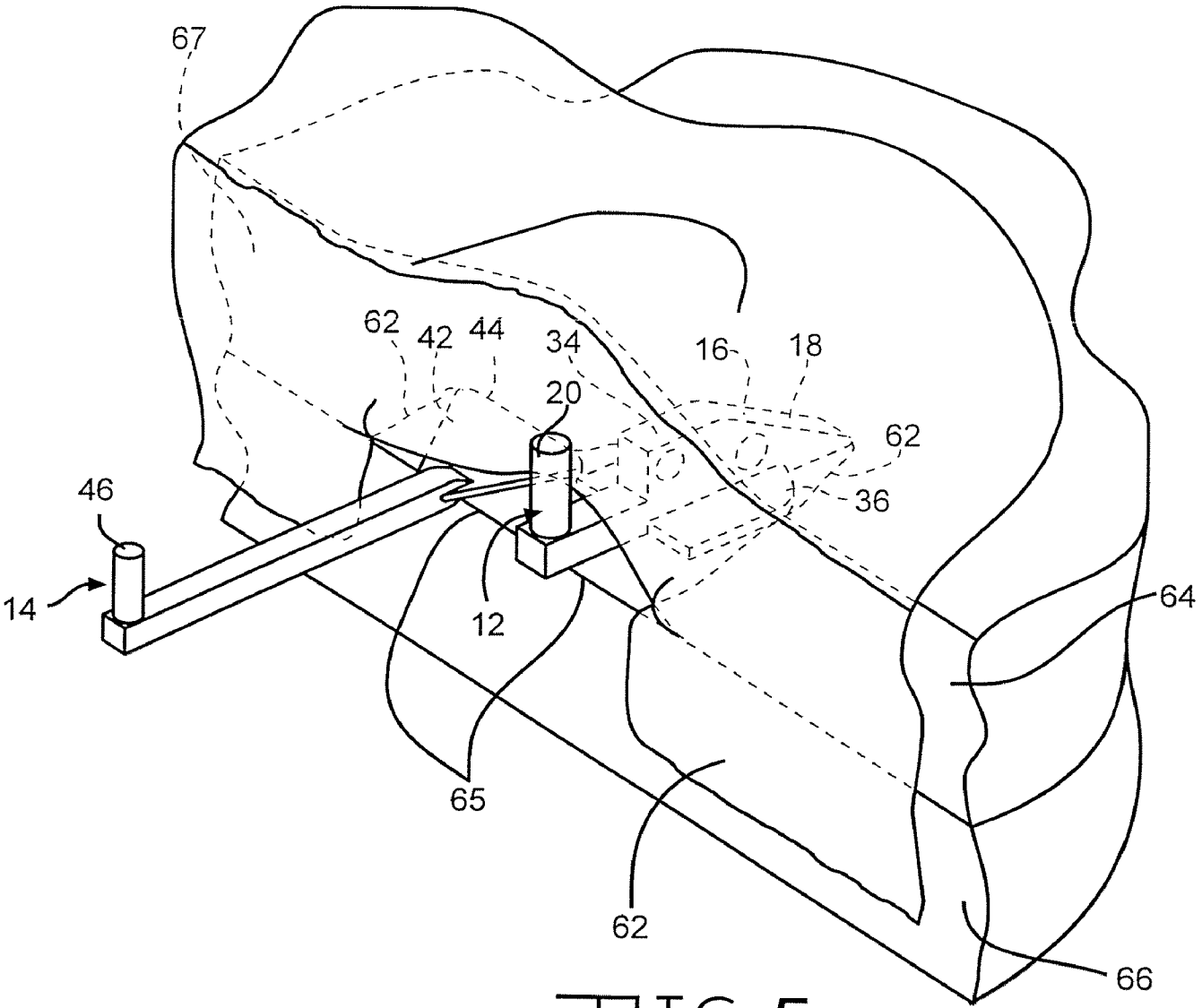
FIG. 5 is a partial, perspective view showing the step of sliding the tuck apparatus of FIG. 4 under the bed mattress under one method embodiment for making a bed under the invention.

In another step of the method, as shown in FIG. 5, after the wedge apparatus 12 is slid under the bed mattress 64, the tucking surface 44 of the tuck apparatus 14 may be slid, while the tuck member 42 is oriented in a substantially horizontal plane, under the bed mattress 64 and above the box spring mattress 66 or other support structure, in order to tuck a portion of the bed covers 62 in between the bed mattress 64 and box spring mattress 66 in the area where the tucking surface 44 is inserted. The tucking surface 44 of the tuck apparatus 14 may be slid under a substantially center area 65 of the side portion 67 of the bed mattress 64, just to either side of the location of the inserted wedge apparatus 12. In other embodiments, the tucking surface 44 of the tuck apparatus 14 may be slid under varying portions of the bed mattress 64 in varying positions relative to the placement of the wedge apparatus 12. For instance, the tucking surface 44 of the tuck apparatus 14 may be slid under, at separate times, substantially center areas on three different sides of the bed mattress in order to tuck in different portions of the bed covers 62 at different areas of the bed mattress 64. In another embodiment, the tucking surface 44 may be slid in between a bed headboard (not shown) and the bed mattress 64 in order to tuck a portion of bed cover 62 in between the bed headboard and bed mattress 64. Movement of the tucking surface 44 may be accomplished by a person grasping the second handle member 46 of the tuck apparatus 14 in order to move the tucking surface 44 as described.

Figure 6:
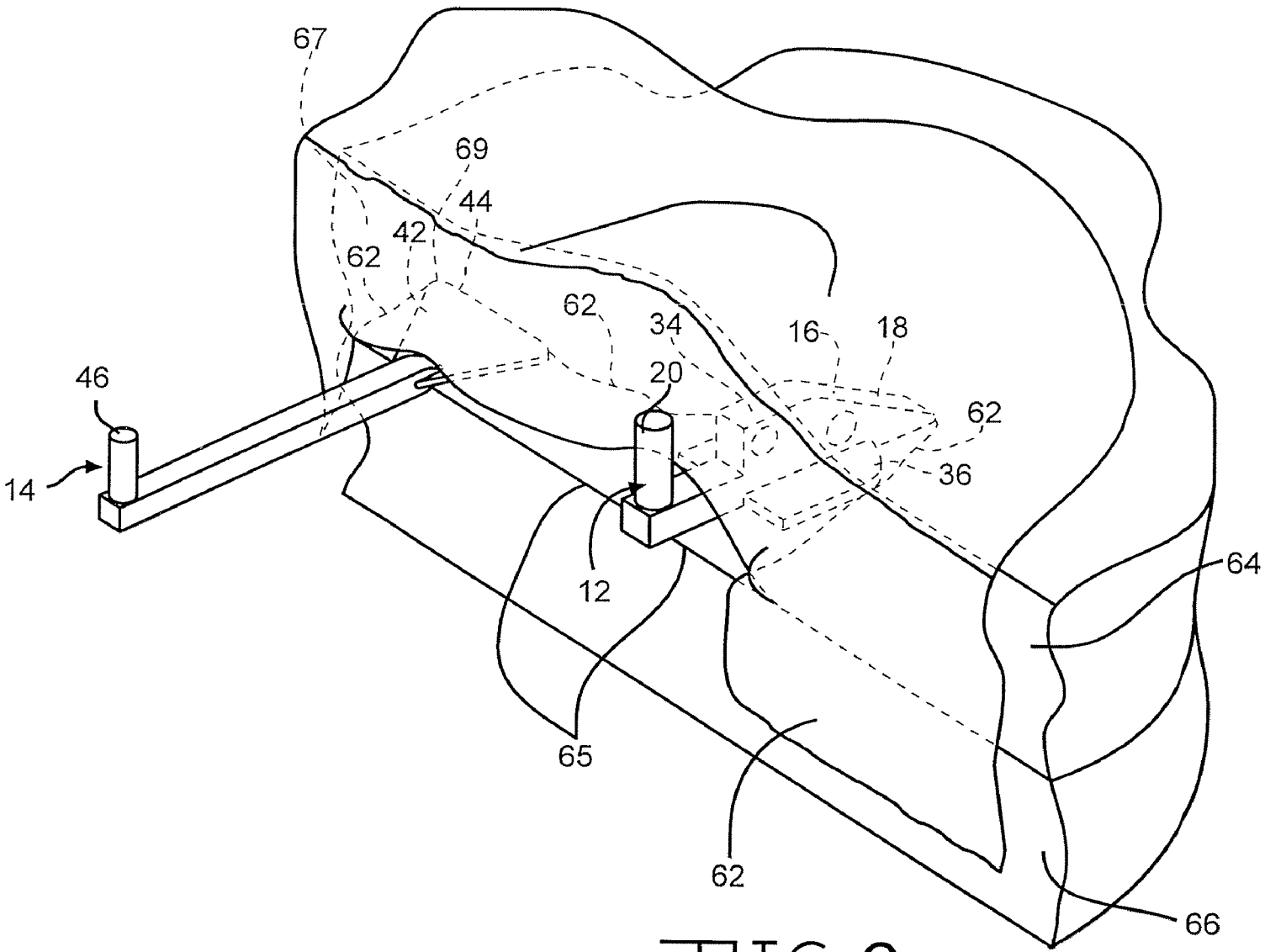
FIG. 6 is a partial, perspective view showing the step of sliding the tuck apparatus of FIG. 5 under and along one side of the bed mattress under one method embodiment for making a bed under the invention.

In still another step of the method, the tucking surface 44 of the tuck apparatus 14 may be slid, while the tuck member 42 is oriented in a substantially horizontal plane, under and along one side of the bed mattress 64 from its position shown in FIG. 5 to its end position 69 under the bed mattress 64 shown in FIG. 6. In such manner the bed covers 62 may be tucked in between the bed mattress 64 and box spring mattress 66, or other support structure, along the entire length of the bed mattress 64 that the tucking surface 44 is slid. In order to tuck in bed covers 62 along varying sides of the bed mattress 66, the tucking surface 44 of the tuck apparatus 14 may be slid along various sides of the bed mattress 66. For instance, the tucking surface 44 of the tuck apparatus 14 may be slid, at different times, from substantially center areas of three side portions of the mattress to three respective end portions of the mattress 64 in order to tuck in the bed covers 62 along three different sides of the mattress 64. In other embodiments, the tucking surface 44 may be slid into and along different areas of varying sides of the bed mattress 66. For instance, the tucking surface 44 may be slid in between, and along, a bed headboard (not shown) and the bed mattress 64 in order to tuck bed cover 62 in between the bed headboard and bed mattress 64.

The wedge apparatus 12 and tuck apparatus 14 may be used in conjunction with each other to tuck in bed covers 62 around the entire mattress 64. For instance, a portion of the wedge apparatus 12 may be slid under a portion of the mattress 64 on one side of the mattress 64. The tuck apparatus 14 may be pressed against a portion of the bed covers 62 on that side of the mattress 64. The tuck apparatus 14 may then be slid under and along that side of the mattress 64 in order to tuck in the bed covers 62 along that side of the mattress 64. Subsequently, the wedge apparatus 12 may be removed from that side of the mattress 64 and slid under a portion of the mattress 64 on a second side of the mattress 64. The tuck apparatus 14 may be pressed against a portion of the bed covers 62 on the second side of the mattress 64. The tuck apparatus 14 may then be slid under and along the second side of the mattress 64 in order to tuck in the bed covers 62 along the second side of the mattress 64. This process may be repeated to tuck in bed covers 62 along as many sides of the bed mattress 64 as desired in order to fully make the bed.

In another embodiment, the invention may comprise the wedge apparatus 12 shown in FIG. 1 without the tuck apparatus 14. The wedge apparatus 12 may allow a portion of a bed mattress 64 to be lifted off a box spring mattress 66, or other support structure. The structure of the wedge apparatus 12 may comprise any of the wedge apparatus 12 embodiments disclosed within this specification.

In still another embodiment, the invention may comprise the tuck apparatus 14 shown in FIG. 1 without the wedge apparatus 12. The tuck apparatus 14 may allow one or more portions of one or more bed covers 62 to be tucked in between a bed mattress 64 and box spring mattress 66, or other support structure. The structure of the tuck apparatus 14 may comprise any of the tuck apparatus embodiments disclosed within this specification.

In yet another embodiment, the invention may comprise a method of sliding the wedge apparatus 12 of FIG. 1 under a bed mattress 64 in order to lift one or more portions of the mattress in an upwardly direction off a box spring mattress 66 or other support structure. The method may not include use of tuck apparatus 14. The structure of the wedge apparatus 12 may comprise any of the wedge apparatus embodiments disclosed within this specification. Similarly, the method of use of the wedge apparatus 12 may comprise any of the methods of use of the wedge apparatus as described in this specification.

In an additional embodiment, the invention may comprise a method of tucking a portion of at least one bed cover 62 under a bed mattress 64 utilizing the tuck apparatus 14 of FIG. 1, without the use of wedge apparatus 12. The structure of the tuck apparatus 14 may comprise any of the tuck apparatus embodiments disclosed within this specification. Similarly, the method of use of the tuck apparatus 14 may comprise any of the methods of use of the tuck apparatus as described in this specification.

One or more embodiments of the disclosed wedge and tuck apparatus and/or methods of the invention may solve one or more problems in lifting bed mattresses and/or tucking in bed covers. The invention may make it less difficult to make a bed, may decrease the force required to make a bed, may decrease the fatigue a person experiences in making a bed, may decrease the likelihood of injury a person may experience in making a bed, may improve efficiency in making a bed, may improve the quality of the made bed, may improve the accuracy, repeatability, and consistency of making a bed, and/or may address other types of problems known in the art.

It should be understood, of course, that the foregoing relates to exemplary embodiments of the invention and that modifications may be made without departing from the spirit and scope of the invention as set forth in the following claims.

We claim:

1. A kit for tucking at least a portion of one bed cover under a mattress of a bed comprising:

a wedge apparatus comprising a wedge member for lifting a portion of said mattress of said bed, said wedge apparatus comprising a bottom surface and a sloped surface, wherein the bottom surface and the sloped surface form an acute angle and first and second side surfaces are disposed between and along said bottom surface and said sloped surface, a first handle member connected to the wedge member, and at least one substantially planar stabilizing surface extending perpendicularly from at least one of said first and second side surfaces in a direction away from both of said first and second side surfaces; and a tuck apparatus comprising a tuck member for tucking said portion of said bed cover under said mattress of said bed comprising at one end of said tuck member at least one tucking surface, and a second handle member connected to said tuck member; and wherein at least one of said first and second handle members is oriented in non-parallel relationship with respect to said bottom surface of said wedge member and said tuck member respectively.

2. The kit of claim 1 wherein the wedge apparatus further comprises a mattress receiving surface oriented in non-parallel relationship with respect to said sloped surface.

3. The kit of claim 2 wherein said sloped surface ends at said mattress receiving surface, and said mattress receiving surface is adapted to be oriented in a substantially horizontal plane when said sloped surface of said wedge member is slid under said mattress.

4. The kit of claim 3 wherein said bottom surface is disposed in a horizontal direction below both of said sloped surface and said mattress receiving surface when said first handle member is pointed in a vertical direction.

* * * * *